US009096345B2

(12) United States Patent
Bogdziewicz et al.

(10) Patent No.: US 9,096,345 B2
(45) Date of Patent: Aug. 4, 2015

(54) PRODUCT DISPENSING SYSTEM WITH REINFORCED WEAKENING FEATURES

(71) Applicant: MeadWestvaco Corporation, Richmond, VA (US)

(72) Inventors: William J. Bogdziewicz, Richmond, VA (US); Christopher A. Moser, Midlothian, VA (US); Stephen G. Simmons, Chesterfield, VA (US); Wojciech A. Blaziak, Midlothian, VA (US)

(73) Assignee: MeadWestvaco Corporation, Richmond, VA (US)

( * ) Notice: Subject to any disclaimer, the term of this patent is extended or adjusted under 35 U.S.C. 154(b) by 118 days.

(21) Appl. No.: 13/972,999

(22) Filed: Aug. 22, 2013

(65) Prior Publication Data

US 2015/0053754 A1 Feb. 26, 2015

(51) Int. Cl.

| | |
|---|---|
| ***B65D 5/72*** | (2006.01) |
| ***B65D 71/36*** | (2006.01) |
| ***A47F 1/08*** | (2006.01) |
| ***B65D 5/02*** | (2006.01) |

(52) U.S. Cl.

CPC ..... *B65D 5/725* (2013.01); *A47F 1/087* (2013.01); *B65D 5/0227* (2013.01); *B65D 71/36* (2013.01); *B65D 2571/0066* (2013.01); *B65D 2571/00141* (2013.01); *B65D 2571/00574* (2013.01); *B65D 2571/00728* (2013.01)

(58) Field of Classification Search

CPC ..... B65D 5/5415; B65D 5/542; B65D 5/725; B65D 5/726; B65D 71/36; B65D 83/00; B65D 2571/561; A47F 1/08; A47F 1/087

See application file for complete search history.

(56) References Cited

U.S. PATENT DOCUMENTS

| | | | | |
|---|---|---|---|---|
| 902,347 | A | 10/1908 | Tillinghast | |
| 1,291,420 | A | 1/1919 | Cough | |
| 1,383,318 | A | 7/1921 | McCormick | |
| 1,393,964 | A | 10/1921 | Potts et al. | |
| 1,516,090 | A * | 11/1924 | Gary et al. | 229/243 |
| 1,753,957 | A | 4/1930 | Washburn | |
| 1,824,937 | A | 9/1931 | Trouth | |
| 1,858,199 | A | 10/1932 | Maziroff | |
| 1,898,056 | A | 2/1933 | Johnson | |
| 1,919,907 | A | 7/1933 | Robinson | |
| 1,932,225 | A | 10/1933 | Minter | |

(Continued)

FOREIGN PATENT DOCUMENTS

| | | |
|---|---|---|
| AT | 6036 U1 | 3/2003 |
| DE | 2655496 | 6/1978 |

(Continued)

OTHER PUBLICATIONS

International Search Report and Written Opinion for PCT/US2014/050801 mailed on Jan. 13, 2015.

*Primary Examiner* — Gary Elkins

(74) *Attorney, Agent, or Firm* — MeadWestvaco Intellectual Property Group

(57) ABSTRACT

A product dispensing system may include a container including a plurality of walls that define an internal volume and an opening into the internal volume, wherein the container defines a plurality of first perforations and at least one first reinforcing feature arranged in a first row extending from the opening and a plurality of second perforations and at least one second reinforcing feature arranged in a second row extending from the opening.

20 Claims, 12 Drawing Sheets

(56) References Cited

U.S. PATENT DOCUMENTS 1,941,458 A 2/1934 Bens
1,985,739 A 12/1934 Murray
2,078,599 A 4/1937 McCauley
2,110,194 A 3/1938 Blier
2,263,353 A 11/1941 Eidam
2,291,187 A 7/1942 Johnson
2,382,191 A 7/1944 Weichselbaum
2,536,421 A 2/1951 Burhans
2,573,381 A 10/1951 Arnold
2,574,087 A 11/1951 Burhans
2,595,122 A 4/1952 Burhans
2,732,619 A 1/1956 Labine
2,784,871 A 3/1957 Gabrielsen
2,795,845 A 6/1957 Shimer
2,818,978 A 1/1958 Post
2,826,471 A 3/1958 Fonda
2,831,591 A 4/1958 Morton
2,888,145 A 5/1959 Knott et al.
2,915,162 A 12/1959 Umstead
2,915,932 A 12/1959 Gross
2,919,488 A 1/1960 Brownlee
2,996,344 A 8/1961 Garman
3,018,149 A 1/1962 Parker
3,055,293 A 9/1962 Lariccia
3,066,827 A 12/1962 Pryor
3,137,068 A 6/1964 Quigley
D198,888 S 8/1964 Heselov
3,178,242 A 4/1965 Ellis et al.
3,184,104 A 5/1965 De Domenico et al.
3,203,554 A 8/1965 Pendergrast et al.
3,204,335 A 9/1965 Hughes
3,288,544 A 11/1966 Knecht
3,300,115 A 1/1967 Schauer
3,304,141 A 2/1967 Rogers
3,306,688 A 2/1967 Di Domenico
3,318,455 A 5/1967 Takahashi
3,335,940 A 8/1967 Dykes
3,340,790 A 9/1967 Simjian
3,348,738 A 10/1967 Hertlein
3,392,901 A 7/1968 Krzyzanowski
3,393,808 A 7/1968 Chirchill
3,501,016 A 3/1970 Eaton
3,664,545 A 5/1972 Beesley
3,763,557 A 10/1973 Sewell
3,784,022 A 1/1974 Beesley, Jr.
3,829,006 A * 8/1974 Spiegel ..... 229/242
3,922,778 A 12/1975 Aalpoel
3,923,159 A 12/1975 Taylor et al.
3,972,454 A 8/1976 Croley
4,105,126 A 8/1978 Deffner et al.
4,205,440 A 6/1980 Morgan
4,260,072 A 4/1981 Quasarano
4,318,458 A 3/1982 Ritsema
4,382,526 A 5/1983 Stone
4,396,143 A 8/1983 Killy
4,435,026 A 3/1984 Johnson
4,456,147 A 6/1984 Tominaga
4,467,524 A 8/1984 Ruff et al.
4,576,272 A 3/1986 Morgan, Jr.
4,598,828 A 7/1986 Young et al.
4,688,677 A 8/1987 Roccaforte
4,729,480 A 3/1988 Groover et al.
4,744,489 A 5/1988 Binder et al.
4,834,263 A 5/1989 Becze
4,869,395 A 9/1989 Rubbmark
4,911,309 A 3/1990 Stefan
4,915,571 A 4/1990 Toshihiko et al.
4,923,070 A 5/1990 Jackle et al.
4,997,106 A 3/1991 Rockola
4,998,628 A 3/1991 Ross
5,033,348 A 7/1991 Walsh
5,080,256 A 1/1992 Rockola
5,101,703 A 4/1992 Tanaka et al.
5,167,345 A 12/1992 Bleeker
5,190,155 A 3/1993 Grunwald
5,251,972 A 10/1993 Zurawin
5,289,943 A 3/1994 Powell
5,314,078 A 5/1994 Morikiyo et al.
5,328,258 A 7/1994 Scalise
5,356,033 A 10/1994 Delaney
5,372,278 A 12/1994 Leight
5,390,821 A 2/1995 Markel
5,396,997 A 3/1995 Johnson
D363,174 S 10/1995 Fletcher, Sr.
5,462,198 A 10/1995 Schwimmer
5,529,207 A 6/1996 Oden et al.
5,638,988 A 6/1997 Rogers
5,685,664 A 11/1997 Parham et al.
5,740,610 A 4/1998 Ayer et al.
5,788,117 A 8/1998 Zimmanck
5,791,048 A 8/1998 Bodnar et al.
5,836,478 A 11/1998 Weiss
5,878,862 A 3/1999 Dewsnap
5,894,942 A 4/1999 Miyashita et al.
5,924,573 A 7/1999 Piraneo et al.
5,992,286 A 11/1999 Boole
5,992,652 A 11/1999 Springs
6,186,345 B1 2/2001 Robertson
6,199,720 B1 3/2001 Rudick et al.
6,206,237 B1 3/2001 Dillon et al.
6,253,930 B1 7/2001 Freidus et al.
6,267,258 B1 7/2001 Wilkerson et al.
6,393,799 B2 5/2002 Jenkins et al.
6,453,641 B1 9/2002 Puckett
6,464,132 B1 * 10/2002 Duquet et al. ..... 229/221
6,637,604 B1 10/2003 Jay
6,802,433 B2 10/2004 Leykin
6,991,116 B2 1/2006 Johnson et al.
7,207,447 B2 4/2007 Medcalf et al.
7,303,095 B2 12/2007 Nagelski et al.
D588,386 S 3/2009 Johnson et al.
D595,074 S 6/2009 Johnson et al.
7,546,973 B2 6/2009 Budz et al.
7,584,854 B2 9/2009 Chandaria
7,614,543 B1 11/2009 Miller
D604,972 S 12/2009 Henry et al.
7,665,618 B2 2/2010 Jay et al.
7,681,745 B2 3/2010 Richter
7,690,518 B2 4/2010 Fincher et al.
7,757,890 B2 7/2010 Alford et al.
D621,644 S 8/2010 Johnson
7,810,672 B1 10/2010 Mason et al.
7,823,733 B2 11/2010 Futori
7,841,479 B2 11/2010 Budge et al.
7,850,015 B1 12/2010 Mason
7,913,860 B2 3/2011 Merl
7,918,365 B2 4/2011 White et al.
7,922,437 B1 4/2011 Loftin et al.
7,992,747 B2 8/2011 Bauer
8,028,855 B2 10/2011 White et al.
8,047,400 B1 11/2011 Luberto et al.
8,302,809 B1 11/2012 Bogdziewicz et al.
8,308,023 B2 11/2012 Gelardi et al.
8,322,543 B2 12/2012 Gelardi et al.
8,833,601 B2 * 9/2014 Zacherle et al. ..... 221/32
2002/0043509 A1 4/2002 Lajeunesse et al.
2003/0173322 A1 9/2003 Rushing
2004/0011751 A1 1/2004 Johnson et al.
2004/0040334 A1 3/2004 Rusnock
2004/0079760 A1 4/2004 Rink
2004/0262326 A1 12/2004 Christensen
2005/0092644 A1 5/2005 Cafferata
2005/0127015 A1 6/2005 Medcalf et al.
2005/0207877 A1 9/2005 Haverdink
2006/0081692 A1 4/2006 Stewart et al.
2006/0237384 A1 10/2006 Neumann et al.
2006/0243683 A1 11/2006 Onachilla et al.
2006/0278591 A1 12/2006 Tippets et al.
2007/0017966 A1 1/2007 Debusk et al.
2007/0194037 A1 8/2007 Close
2008/0245813 A1 10/2008 Johnson et al.
2009/0039040 A1 2/2009 Johnson et al.
2009/0212066 A1 8/2009 Bauer
2009/0266776 A1 10/2009 Johnson

(56) References Cited

U.S. PATENT DOCUMENTS

| | | | | |
|---|---|---|---|---|
| 2009/0277853 | A1 | 11/2009 | Bauer | |
| 2009/0308885 | A1 | 12/2009 | Sainato et al. | |
| 2010/0032391 | A1 | 2/2010 | Schneider et al. | |
| 2010/0096401 | A1 | 4/2010 | Sainato et al. | |
| 2011/0121010 | A1 | 5/2011 | Loftin et al. | |
| 2011/0121011 | A1 | 5/2011 | Gelardi et al. | |
| 2011/0121022 | A1 | 5/2011 | Sholl et al. | |
| 2012/0018391 | A1 | 1/2012 | Gelardi et al. | |
| 2012/0074016 | A1 | 3/2012 | Gelardi et al. | |
| 2012/0074160 | A1 | 3/2012 | Thomas et al. | |
| 2012/0074164 | A1 | 3/2012 | Walling et al. | |
| 2012/0080513 | A1 | 4/2012 | Thomas et al. | |
| 2012/0097694 | A1 | 4/2012 | Gelardi | |
| 2012/0152970 | A1 | 6/2012 | Thomas | |
| 2012/0211522 | A1 | 8/2012 | Gelardi et al. | |
| 2012/0217213 | A1 | 8/2012 | Thomas | |
| 2012/0217261 | A1 | 8/2012 | Bailey et al. | |
| 2012/0223090 | A1 | 9/2012 | Thomas et al. | |
| 2012/0279893 | A1 | 11/2012 | Gelardi et al. | |
| 2012/0285976 | A1 | 11/2012 | Bogdziewicz et al. | |
| 2012/0285977 | A1 | 11/2012 | Bates et al. | |
| 2013/0134177 | A1* | 5/2013 | Loftin | 221/1 |
| 2013/0221017 | A1 | 8/2013 | Zacherle et al. | |
| 2013/0233813 | A1* | 9/2013 | Zacherle et al. | 211/59.2 |
| 2013/0277385 | A1* | 10/2013 | Zacherle | 221/197 |

FOREIGN PATENT DOCUMENTS

| | | | |
|---|---|---|---|
| DE | 29808673 | | 11/1998 |
| DE | 19808162 | | 9/1999 |
| DE | 20111307 | | 10/2001 |
| DE | 202007012114 | | 11/2007 |
| EP | 0899201 | A1 | 3/1999 |
| FR | 2415051 | | 8/1979 |
| GB | 1283210 | | 7/1972 |
| GB | 2190906 | | 12/1978 |
| GB | 2303624 | | 2/1997 |
| JP | 03105494 | A | 5/1991 |
| JP | 03133737 | A | 6/1991 |
| JP | 03198192 | A | 8/1991 |
| JP | 03273469 | A | 12/1991 |
| JP | 03273470 | A | 12/1991 |
| JP | 03273471 | A | 12/1991 |
| JP | 03273472 | A | 12/1991 |
| JP | 03273474 | | 12/1991 |
| JP | 03273476 | A | 12/1991 |
| JP | 03273477 | A | 12/1991 |
| JP | 03273480 | A | 12/1991 |
| JP | 03273482 | A | 12/1991 |
| JP | 03273483 | A | 12/1991 |
| JP | 04086985 | A | 3/1992 |
| JP | 04115392 | A | 4/1992 |
| JP | 04137194 | A | 5/1992 |
| JP | 05004640 | A | 1/1993 |
| JP | 05174239 | A | 7/1993 |
| JP | 05346984 | A | 12/1993 |
| JP | 08161611 | A | 6/1996 |
| JP | 09027066 | A | 1/1997 |
| JP | 09102065 | A | 4/1997 |
| JP | 09282537 | A | 10/1997 |
| JP | 09311971 | A | 12/1997 |
| JP | 10269421 | A | 10/1998 |
| JP | 11011471 | A | 1/1999 |
| JP | 11171264 | A | 6/1999 |
| JP | 11191175 | A | 7/1999 |
| JP | 11328513 | A | 11/1999 |
| JP | 2001072076 | A | 3/2001 |
| JP | 2001206358 | A | 7/2001 |
| JP | 2003327243 | A | 11/2003 |
| JP | 2004017970 | A | 1/2004 |
| JP | 2005338910 | A | 12/2005 |
| JP | 04157593 | B1 | 10/2008 |
| WO | WO 9106076 | | 5/1991 |
| WO | WO 9321074 | | 10/1993 |
| WO | WO 9423619 | | 10/1994 |
| WO | WO 0054632 | | 9/2000 |
| WO | WO 2004014755 | | 2/2004 |
| WO | WO 2004113808 | | 12/2004 |
| WO | WO2009029603 | | 5/2009 |
| WO | WO 2009138538 | | 11/2009 |
| WO | WO 2011025483 | | 3/2011 |
| WO | WO 2011030320 | | 3/2011 |
| WO | WO 2011109350 | | 9/2011 |

* cited by examiner

PRODUCT DISPENSING SYSTEM WITH REINFORCED WEAKENING FEATURES

FIELD

The present disclosure is generally related to dispensing products from packaging containers and, more particularly, to product dispensers configured to cooperate with packaging containers having reinforced weakening features to dispense products.

BACKGROUND

Products are typically shipped to retailers in bulk by enclosing multiple individual product units in a container, such as a carton or box. For example, canned foods may be shipped to a retailer in a box containing a number of individual cans. Then, it is typically the retailer's obligation to remove the individual product units from the container and present them to consumers.

Alternatives to the traditional package-ship-unpack-display model are being developed in an effort to improve operating efficiency. For example, U.S. Pat. No. 7,922,437 to Loftin et al. discloses a system for dispensing and displaying products packaged in a container. Specifically, the system includes a frame having a support structure, a product display area and an opening tool. The frame may be positioned on a retailer's shelf and loaded with product simply by placing a container comprising multiple units of product onto the support structure of the frame. As the container is being placed onto the support structure, the opening tool of the frame opens the container in such a manner that products roll from the container and down to the product display area of the frame under the force of gravity.

As another example, U.S. Pat. Pub. No. 2012/0211522 filed by Gelardi et al. discloses a product dispensing system that utilizes an opening tool having a catch element that engages and opens a container as the container is loaded onto the dispenser, and then guides the container to avoid interference between the dispensing products and the open container.

Despite advances already made in the field, those skilled in the art continue with research and development efforts directed to systems and methods for dispensing products from packaging containers.

SUMMARY

In one embodiment, the disclosed product dispensing system may include a container including a plurality of walls that define an internal volume and an opening into the internal volume, wherein the container defines a plurality of first perforations and at least one first reinforcing feature arranged in a first row extending from the opening and a plurality of second perforations and at least one second reinforcing feature arranged in a second row extending from the opening.

In another embodiment, the disclosed product dispensing system may include a container including at least a base wall and a rear wall that define an internal volume and an opening into the internal volume, and wherein the base wall defines a plurality of first perforations and a plurality of first reinforcing features arranged in a first row extending from the opening, and a plurality of second perforations and a plurality of second reinforcing feature arranged in a second row extending from the opening, a plurality of products received in the internal volume of the container, and a dispenser including a frame including a front end and a rear end, the frame including a support deck configured to support the container, and a catch element connected to the support deck, the catch element being positioned to extend through the opening when the container is loaded onto the support deck.

In yet another embodiment, also disclosed is a method for dispensing, the method may include the steps of: (1) providing a container housing a plurality of products, the container including a plurality of first perforations and at least one first reinforcing feature arranged in a first row, and a plurality of second perforations and at least one second reinforcing feature arranged in a second row, wherein the first row and the second row define an access panel, (2) providing a dispenser including a frame configured to support the container and a catch element connected to the frame, and (3) urging the container along the frame such that the catch element separates the access panel about the first row and the second row and allows at least one product of the plurality of products to be dispensed from the container.

Other embodiments of the disclosed product dispensing system will become apparent from the following detailed description, the accompanying drawings and the appended claims.

DETAILED DESCRIPTION

Figure 1:
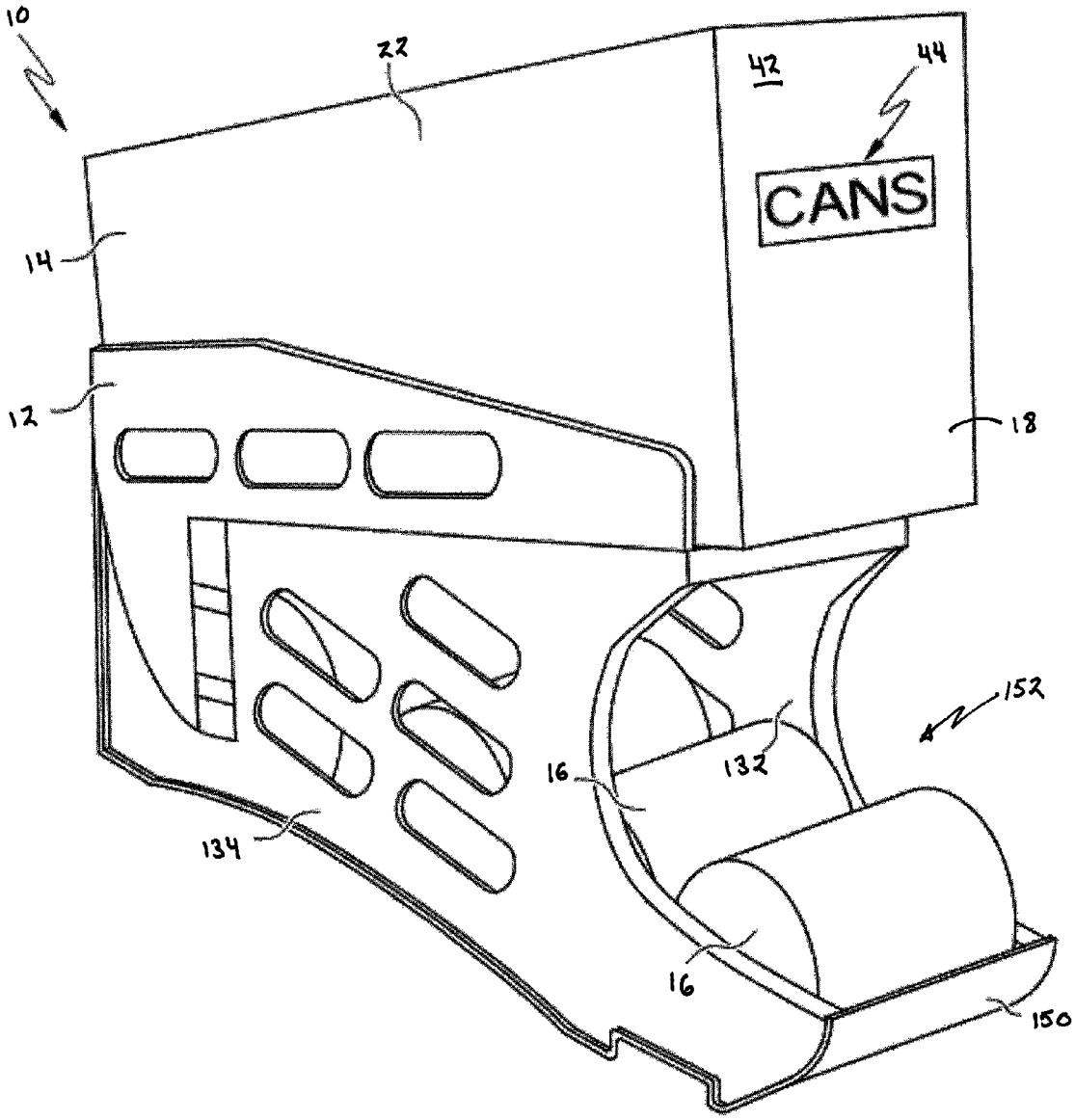
FIG. 1 is a front and side perspective view of one embodiment of the disclosed product dispensing system.

The following detailed description refers to the accompanying drawings, which illustrate specific embodiments of the disclosure. Other embodiments having different structures and operations do not depart from the scope of the present disclosure. Like reference numerals may refer to the same element or component in the different drawings.

Referring to FIG. 1, one embodiment of the disclosed product dispensing system, generally designated 10, may include a dispenser 12 and a container 14. The container 14 may house multiple units of product 16. The container 14 may be loaded onto the dispenser 12 by urging the container 14 generally horizontally along the dispenser 12. As the container 14 is urged along the dispenser 12, the dispenser 12 may engage and open the container 14, thereby releasing the products 16 from the container 14 to the dispenser 12.

The container 14 may be any container capable of housing products 16 and beneficially interacting with the disclosed dispenser 12. For example, the container 14 may be a paperboard carton or a corrugated box.

Figure 2:
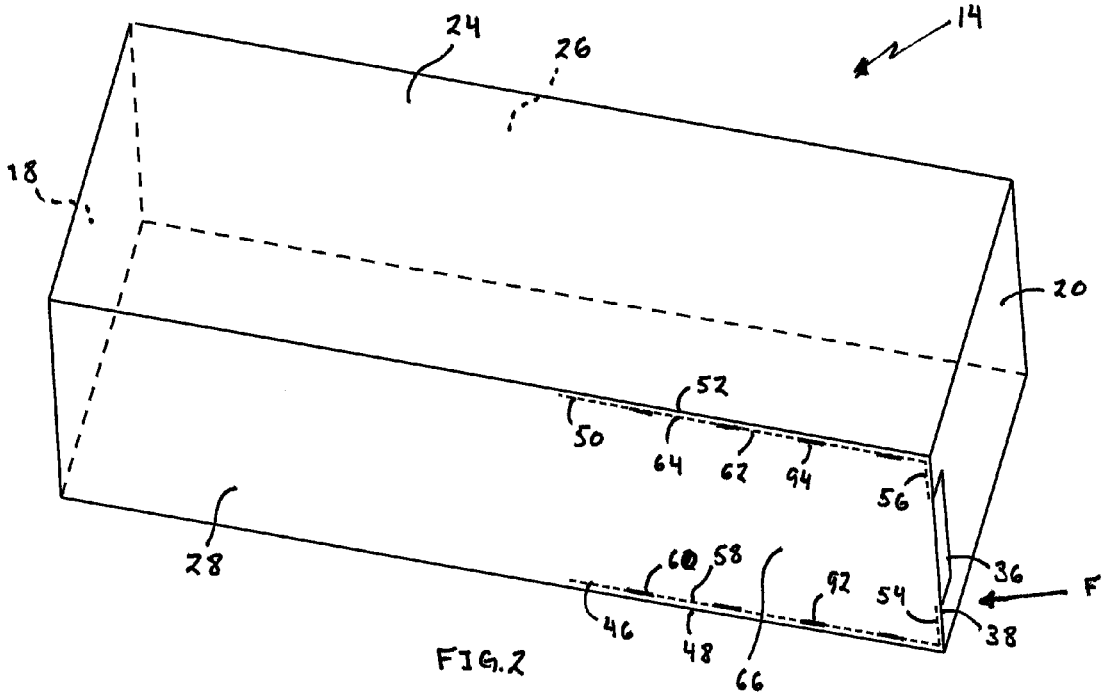
FIG. 2 is a bottom and side perspective view of one embodiment of the container of the disclosed product dispensing system of FIG. 1.

Referring to FIG. 2, the container 14 may be a generally rectilinear container having six walls 18, 20, 22, 24, 26, 28 that define an internal volume 30 for receiving the products 16 (FIG. 1). Opposed walls may define a front wall 18 and a rear wall 20 of the container 14. Opposed walls may define a first (e.g., left) sidewall 22 and second (e.g., right) sidewall 24 of the container 14. Opposed walls may define an upper wall 26 and a base wall 28 of the container 14.

In an example embodiment, the container 14 may include a pre-formed initiation opening 36 (FIG. 2) that opens into the internal volume 30 of the container 14. The initiation opening 36 may extend generally laterally between the sidewalls 22, 24 of the container 14. For example, the initiation opening 36 may extend from proximate the left sidewall 22 to proximate the right sidewall 24. As another example, the initiation opening 36 may be spaced away from both the left sidewall 22 and the right sidewall 24.

In an example construction, the rear wall 20 of the container 14 may include the initiation opening 36. The initiation opening 36 may be formed in the rear wall 20 proximate (e.g., at or near) the base wall 28 of the container 14. For example, the initiation opening 34 may be formed along an edge 38 of the container 14 between the base wall 28 and the rear wall 20. For example, the initiation opening 34 may be located substantially in the middle of the rear wall 20 and extend from the edge 38 toward the upper wall 26.

Those skilled in the art will appreciate that the initiation opening 36 may be positioned at various alternative locations and may have various alternative configurations, provided that the initiation opening 36 is capable of being engaged by the dispenser 12 when the container 14 is being loaded onto the dispenser 12, as will be described in more detail herein.

As an alternative example construction, the base wall 28 of the container 14 may include the initiation opening 36. The initiation opening 36 may be formed in the base wall 28 proximate the rear wall 20 of the container 14. For example, the initiation opening 34 may be formed along the edge 38 between the base wall 28 and the rear wall 20. For example, the initiation opening 34 may be located substantially in the middle of the base wall 28 and extend from the edge 38 toward the front wall 18.

As another alternative example construction, the initiation opening 36 may be formed in the base wall 28 proximate, but spaced away from, the rear wall 20 of the container 14. As yet another alternative example construction, the initiation opening 36 may be formed in the base wall 28 between the front wall 18 and the rear 20 wall of the container 14. Other constructions are also contemplated.

Optionally, a peelable label or the like (not shown) may be applied to the container 14 over the pre-formed initiation opening 36. Therefore, the initiation opening 36 may be revealed by peeling away the optional peelable label from the container 14.

Figure 3:
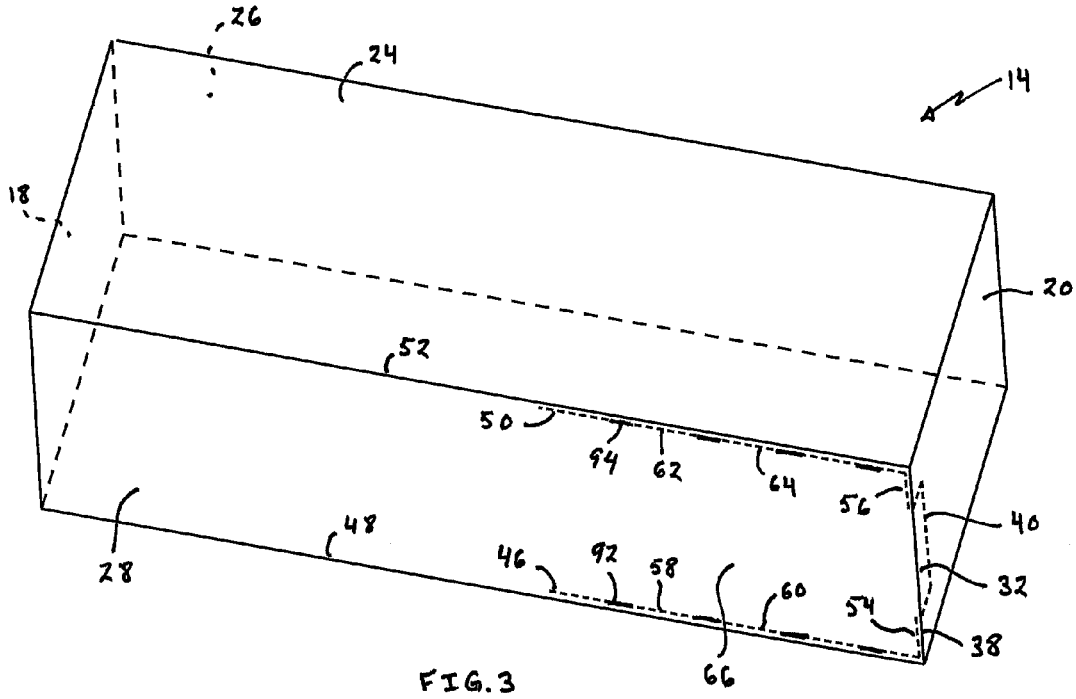
FIG. 3 is a bottom and side perspective view of another embodiment of the container of FIG. 1.

Referring to FIG. 3, in another example embodiment, the container 14 may include a removable priming feature 32 (FIG. 3). The priming feature 32 may be defined by a plurality of weakening features 40 defining an outline of the initiation opening 36. The priming feature 32 may be removed from the container 14 to reveal the initiation opening 36.

In an example construction, the rear wall 20 of the container may include the removable priming feature 32. The priming feature 32 may be positioned such that the initiation opening 36 is formed in the rear wall 20 proximate the base wall 28 of the container 14. In another example construction, the base wall 26 of the container 14 may include the removable priming feature 32. The priming feature 32 may be positioned such that the initiation opening 36 is formed in the base wall 28 proximate the rear wall 20 of the container 14.

Thus, prior to loading the container 14 onto the dispenser 12, a user may remove the priming feature 32 from the container 14, such as by tearing or punching-out the removable priming feature 32 from the container 14 along the weakening features 40 thereby forming the initiation opening 34 (FIG. 2).

In an example implementation, the priming feature 32 may be a zipper strip or punch-out defined by a plurality of intersecting rows of perforations or cuts allowing the priming feature 32 to be completely removed from the container. For example, the priming feature 32 may be defined by two parallel rows of perforations or cuts extending substantially perpendicularly from the edge 38 and two parallel rows of perforations or cuts substantially parallel to the edge 38.

As another example implementation, the priming feature 32 may be a flap defined by a plurality of intersecting perforations or cuts allowing the priming feature 32 to be pivotally attached to the container 14 (e.g., a foldable flap). For example, the priming feature 32 may be defined by two parallel rows of perforations or cuts extending substantially perpendicularly from the edge 38 and one row of perforations or cuts spaced away from and substantially parallel to the edge 38 such that at least a portion of the priming feature 32 remains connected to the container 14 proximate the edge 38.

Those skilled in the art will appreciate that weakening features 40 other than perforations and cuts may also be used.

Referring still to FIGS. 2 and 3, a first weakening feature 46 may generally longitudinally extend from the initiation opening 36 toward the front wall 18 of the container 14. The first weakening feature 46 may be formed in the base wall 28 proximate an edge 48 between the base wall 28 and the left sidewall 22.

A second weakening feature 50 may generally longitudinally extend from the initiation opening 36 toward the front wall 18 of the container 14. The second weakening feature 50 may be formed in the base wall 28 proximate an edge 52 between the base wall 28 and the right sidewall 24. The second weakening feature 50 may be substantially parallel to the first weakening feature 46.

Depending upon the size of the initiation opening 36, additional weakening features (e.g., a third weakening feature 54 and a fourth weakening feature 56) may extend from the first weakening feature 46 and the second weakening feature 50 to the initiation opening 36.

The third weakening feature 54 may extend generally laterally from the first weakening feature 46 to the initiation opening 36 (e.g., from proximate the edge 48 to the initiation opening 36). The third weakening feature 54 may be formed in the base wall 28 proximate the edge 38 between the base wall 28 and the rear wall 20.

The fourth weakening feature 56 may extend generally laterally from the second weakening feature 50 to the initiation opening 36 (e.g., from proximate the edge 52 to the initiation opening 36). The fourth weakening feature 56 may be formed in the base wall 28 proximate the edge 38 between the base wall 28 and the rear wall 20.

The longitudinal length of the first and second weakening features 46, 50 may be dictated by the size (e.g., the diameter) of the products 16 housed in the container 14. As one example, the first and second weakening features 46, 50 may extend along at least 5 percent of the length of the edges 48, 52. As another example, the first and second weakening features 46, 50 may extend along at least 10 percent of the length of the edges 48, 52. As another example, the first and second weakening features 46, 50 may extend along at least 20 percent of the length of the edges 48, 52. As another example, the first and second weakening features 46, 50 may extend along at least 30 percent of the length of the edges 48, 52. As yet another example, the first and second weakening features 46, 50 may extend along at least 50 percent of the length of the edges 48, 52.

Figure 4:
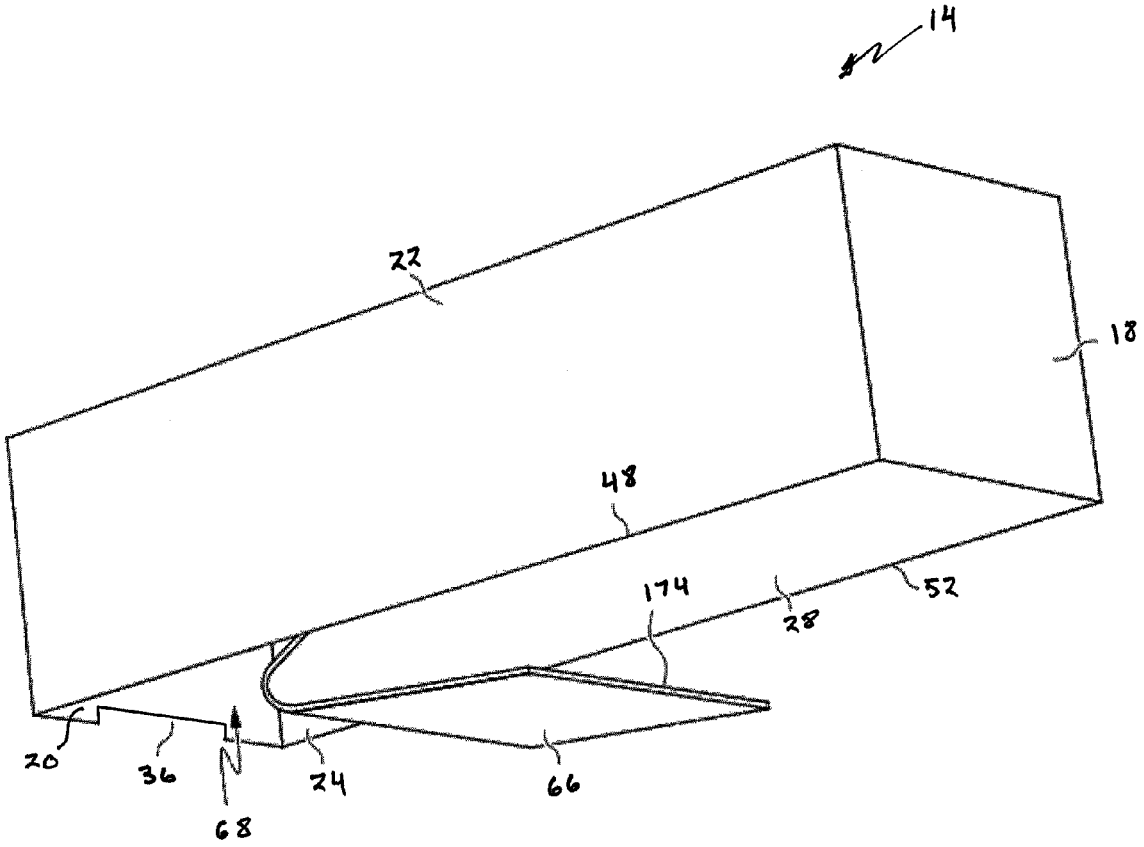
FIG. 4 is a bottom and side perspective view of the container of FIG. 2, shown in an opened configuration.

Referring to FIG. 4, the first and second weakening features 46, 50 (and optionally the third and fourth weakening features 54, 56) may facilitate the separation (e.g., tearing) of a portion of the base wall 28 from the rest of the container 14. In an example implementation, the first weakening feature 46 may be formed by a plurality of first perforations 58 and one or more first reinforcing features 92 (FIG. 2) arranged in a first row 60. The second weakening feature 50 may be formed by a plurality of second perforations 62 and one or more second reinforcing features 94 (FIG. 2) arranged in a second row 64. The third and fourth weakening features 54, 56 may be formed as rows of perforations.

As used herein, "perforation" broadly refers to any structure (or absence of structure) that may be used to form the first and second weakening features 46, 50 (and the third and fourth weakening features 54, 56), and includes traditional, generally circular (in plan view) perforations, as well as elongated punctures or cuts. For example, the first and second weakening features 46, 50 may be formed as rows of standard perforations, as rows of micro perforations or as rows of cuts, such as zipper-like cuts. Other techniques useful for forming the first and second weakening features 46, 50 will become apparent to those skilled in the art.

Thus, a force F (FIG. 2) applied to the base wall 28 at the initiation opening 36 may partially separate a portion of the base wall 28 from the container 14 along the first and second weakening features 46, 50 (and the third and fourth weakening features 54, 56) to form an access panel 66. As the access panel 66 is separated from the remainder of the container 14, the size of the initiation opening 36 may be significantly increased, thereby forming an access opening 68 in the container 14. The access opening 68 may allow the products 16 housed in the container 14 to be dispensed from the container 14 and, ultimately, into the dispenser 12 when the container 14 is loaded on the dispenser 12, as will be discussed in greater detail herein.

Figure 5:
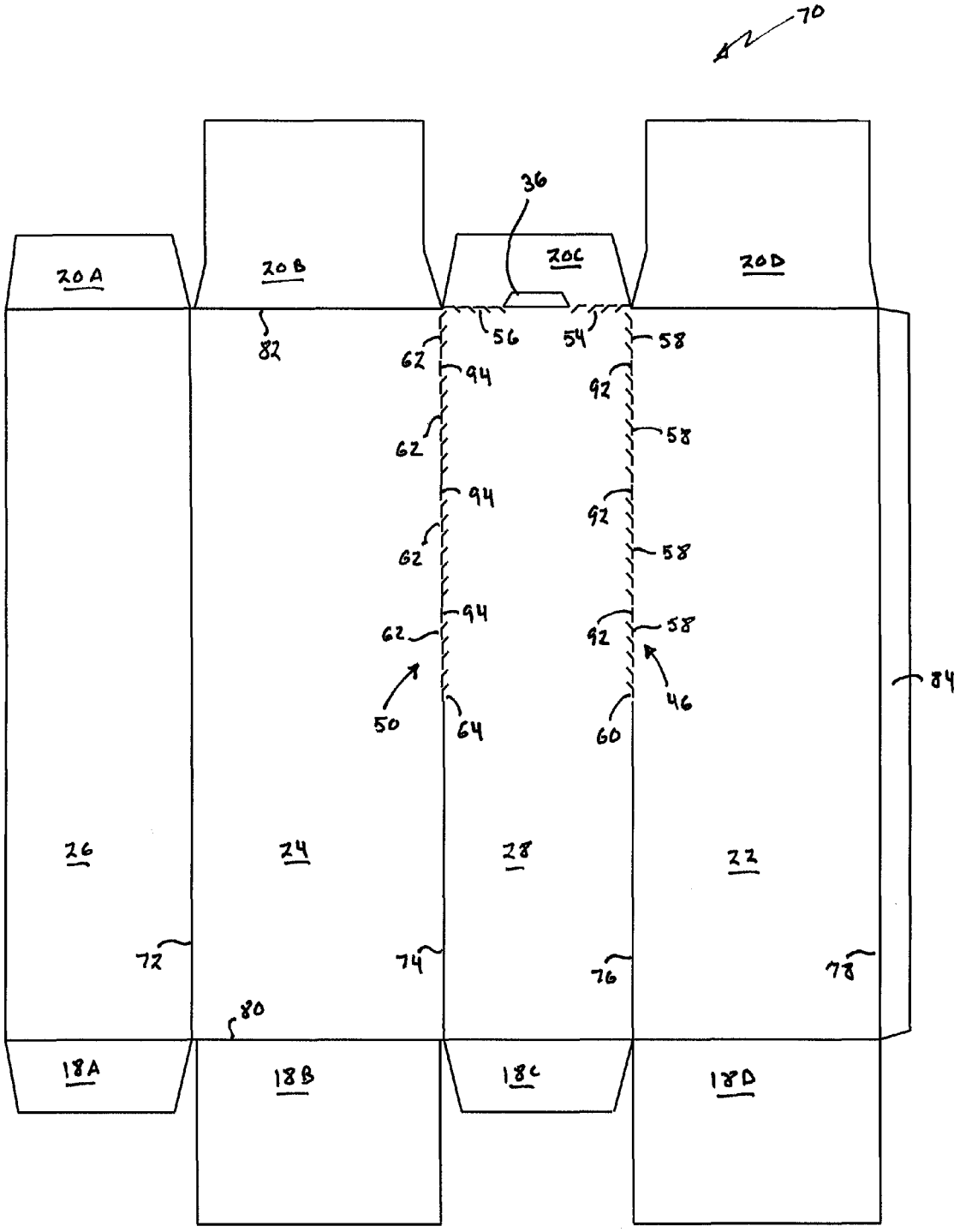
FIG. 5 is a top plan view of a container blank that may be used to form the container of FIG. 2.

Referring to FIG. 5, the container 14 may be formed from a paperboard container blank 70. The container 14 may be assembled on a container machine using the container blank 70 that has been pre-cut from a sheet of stock material.

The container blank 70 may include a plurality of preformed fold lines 72, 74, 76, 78, 80, 82 that define the front wall 18 (comprised of front wall panels 18A, 18B, 18C and 18D), the rear wall 20 (comprised of rear wall panels 20A, 20B, 20C and 20D), the left side wall 22, the right side wall 24, the upper wall 26, the base wall 28 and sealing panel 84.

The container 14 may be assembled by folding the container blank 70 along the longitudinal fold lines 72, 74, 76, 78 and connecting the upper wall 26 to the sealing panel 84 to form the three-dimensional body of the container 14. Then, the front wall panels 18A, 18B, 18C, 18D may be assembled to form the front wall 18 of the container 14. Finally, the rear wall panels 20A, 20B, 20D, 20D may be assembled to form the rear wall 20 of the container 14.

The container blank 70 may be formed from a paperboard-based material, such as C1S paperboard, which may have a coating (e.g., clay) on a first major surface thereof, which may form the outer surface of the container 14, and an uncoated second major surface. As another example, the stock material may be C2S paperboard, which may have a coating (e.g., clay) on both major surfaces thereof. Optionally, the outer surface 42 of the container 14 may be marked with various container indicia 44, such as printed text and graphics, for example to identify the type of product 16 or the manufacturer of the product 16.

While a specific paperboard container blank 70 is shown and described, those skilled in the art will appreciate that various techniques and materials may be used to form the container 14. Folded paperboard containers are only one specific and non-limiting example of the disclosed container 14.

Figure 6:
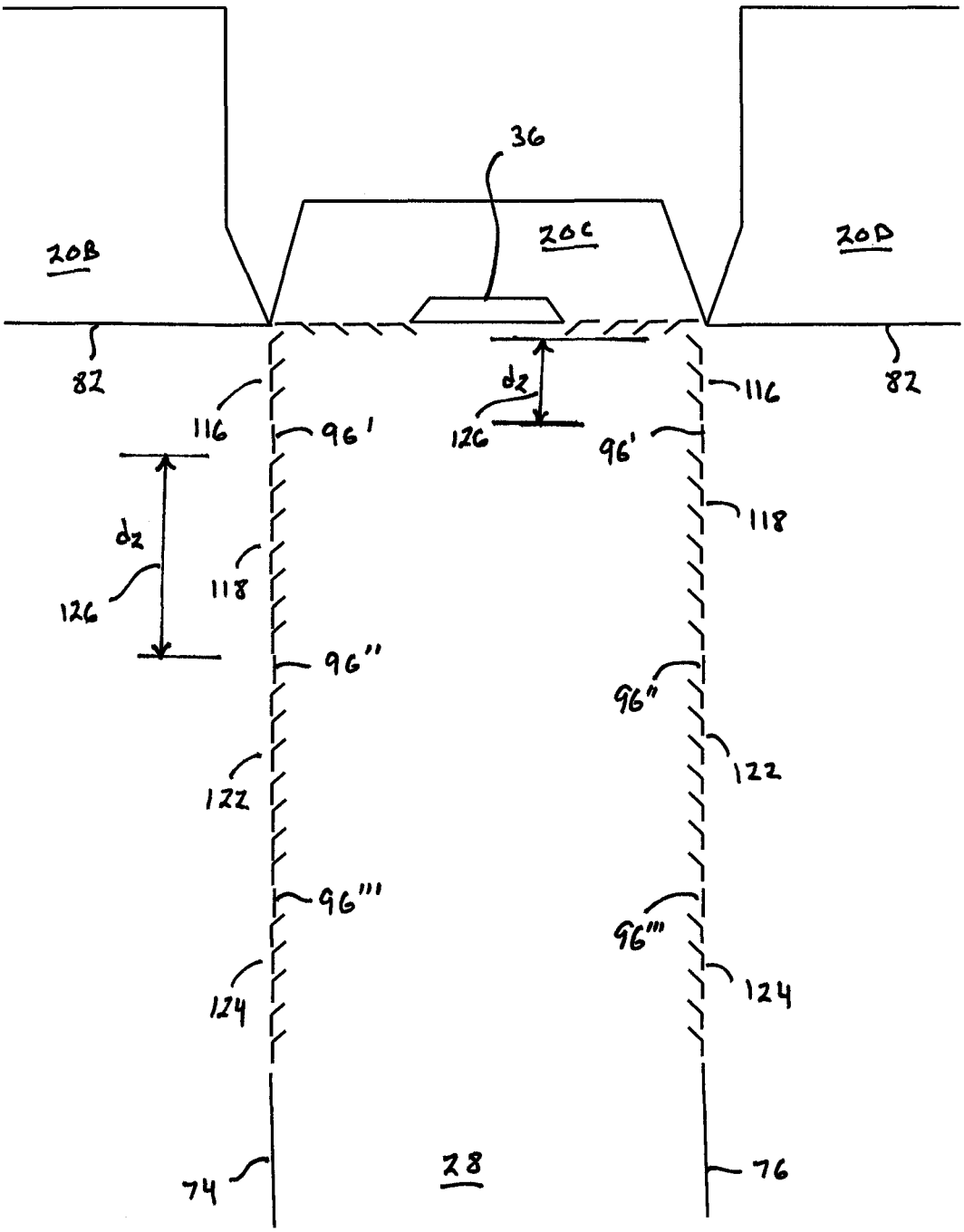
FIG. 6 is a detailed top plan view of a portion of the container blank of FIG. 5.

Referring to FIGS. 5 and 6, the first and second weakening features 46, 50 may contain rows 60, 64 of generally longitudinally aligned perforations 58, 62 and reinforcing features 92, 94. Laterally opposed individual perforations 58, 62 of each row 60, 64 may be aligned or offset (e.g., staggered). For example, the first perforations 58 in the first row 60 of the first weakening feature 46 may be aligned with the second perforations 62 in the second row 64 of the second weakening feature 50. As another example, the first perforations 58 in the first row 60 of the first weakening feature 46 may be offset in relation to the second perforations 62 in the second row 64 of the second weakening feature 50.

Figure 7:
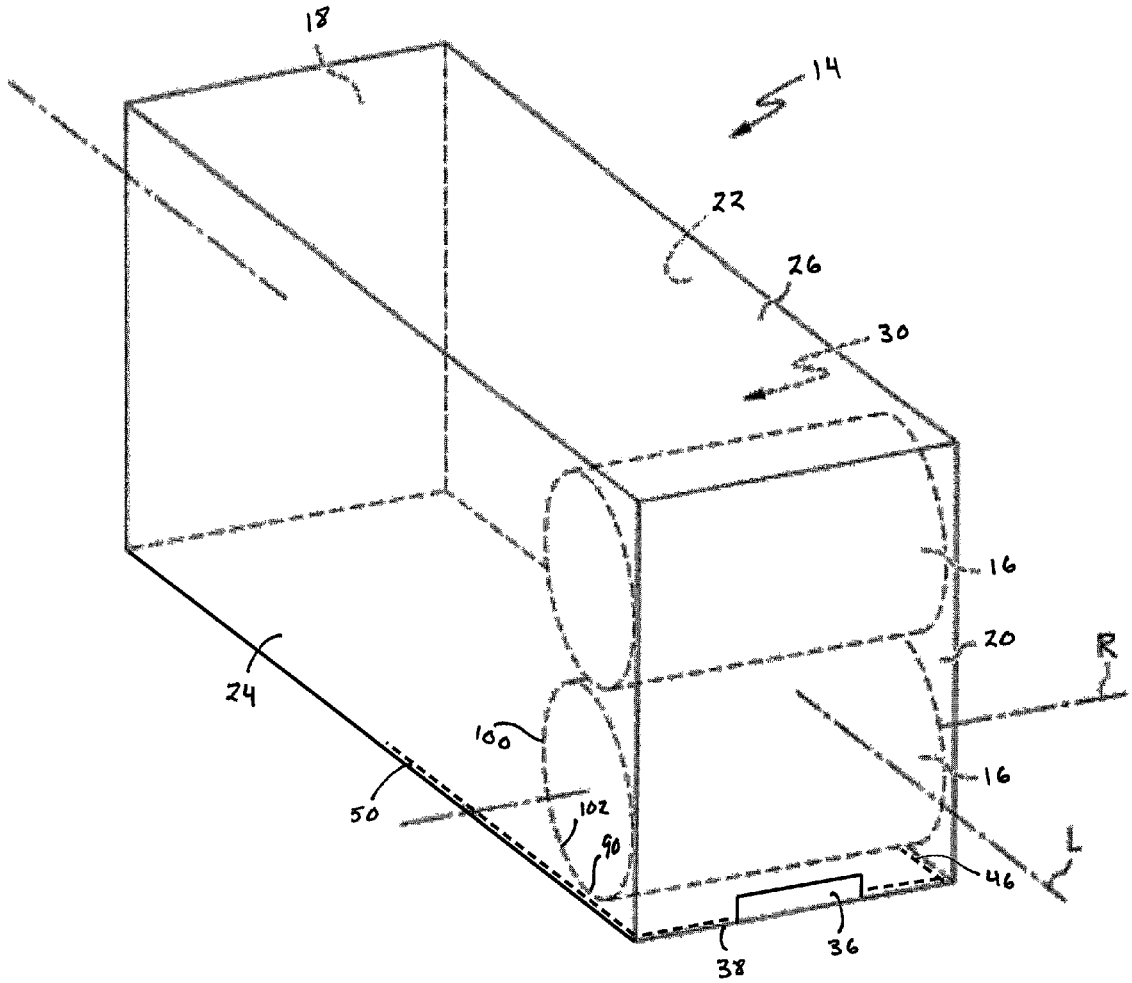
FIG. 7 is rear and side perspective view of the container of FIG. 2.

Referring to FIG. 7, the container 14 may be a generally rectilinear container having a longitudinal axis L. Products 16 having various shapes and configurations may be housed in the internal volume 30 of the container 14 and dispensed by the disclosed product dispensing system 10 (FIG. 1). Suitable products 16 may include cans (e.g., canned soup, canned drinks, or pet food), jars (e.g., jarred sauce), or bottles (e.g., bottled soft drinks). The products 16 may be capable of rolling about a rolling axis R. For example, the products 16 may be substantially cylindrical in shape (e.g., canned soup, canned drinks, or pet food).

Figure 8:
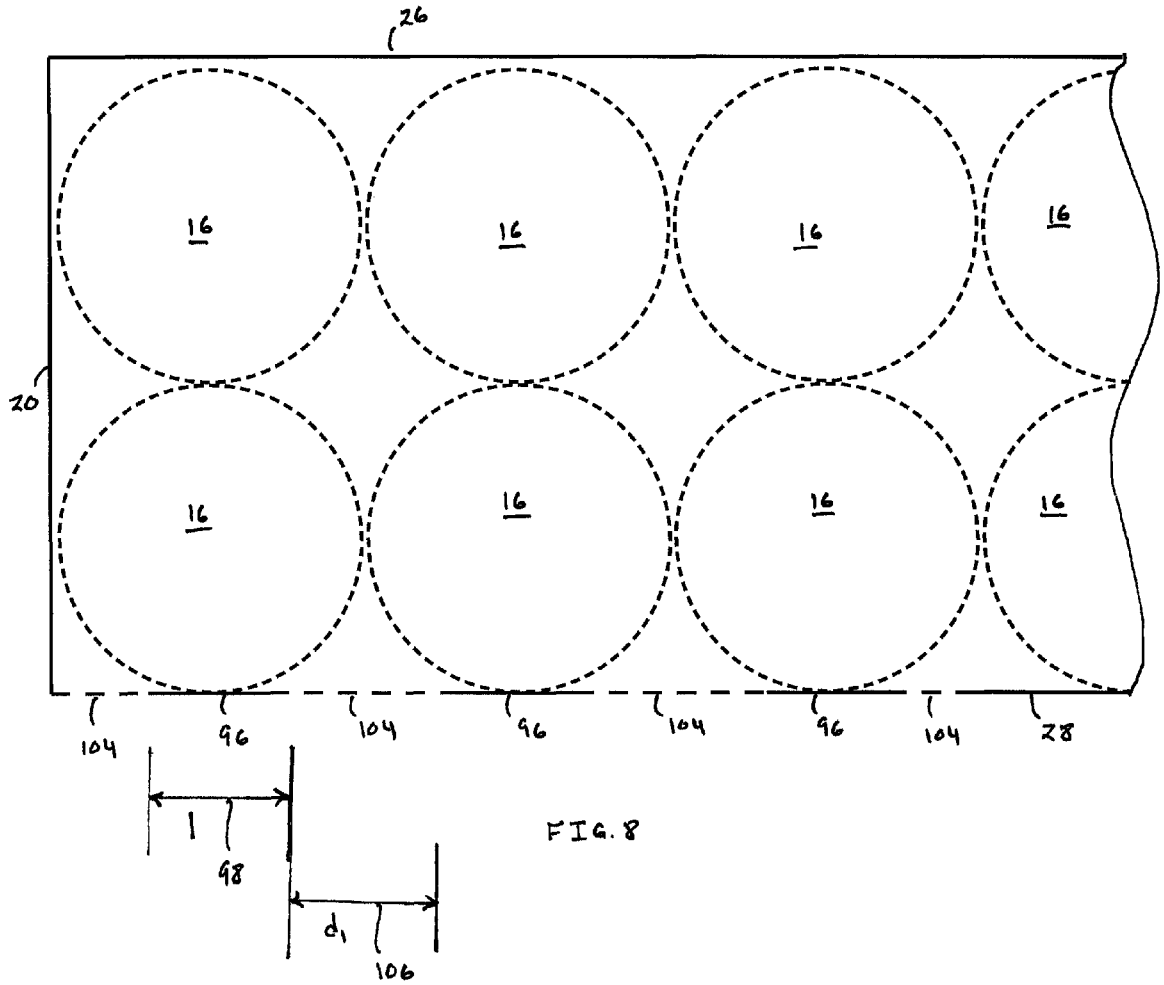
FIG. 8 is a partial side elevational view of the container of FIG. 2.

The products 16 may be arranged in various ways within the container 14. As one example, the products 16 may be arranged in a single longitudinal row, with one row of products 16 between opposing walls of the container 14 (e.g., between the sidewalls 22, 24). As another example, the products 16 may be arranged in two stacked longitudinal rows, with only one row of products 16 between opposing walls of the container 14 (e.g., between the sidewalls 22, 24), as shown in FIGS. 7 and 8. Other configurations and arrangements of the products 16 within the container 14 are also contemplated.

When the container 14 contains a full complement of product 16 (e.g., prior to removal of the access panel 66 and the products 16 being dispensed by the disclosed product dispensing system 10), at least a portion of the products 16 positioned adjacent to the rear wall 20 and longitudinally extending toward the front wall 18 (FIG. 7) may be supported only by the portion of the base wall 28 defining the access panel 66. Thus, at least a portion of the product 16 may be positioned proximate (e.g., at or near) the first and second weakening features 46, 50.

For example, opposed ends 100 of the product 16 may be proximate the left and right sidewalls 22, 24 and at least a portion of each end 100 of the product 16 may be in contact with the base wall 28 proximate the edges 48, 52 of the container 14. For example, at least a portion of a perimeter edge 102 of each end 100 of the product 16 (e.g., a tangent point 90) may be very near or in direct contact with the first and second weakening features 46, 50, respectively.

As used herein, "tangent point" broadly refers to a portion of an exterior surface of the product 16 that is in contact with a surface (e.g., interior surface of the base wall 28) of the container 14. For example, the tangent point 90 may be a partial length of a circumference of the product 16. As a specific, non-limiting example, the tangent point 90 may be a circumferential segment of the perimeter edge 102 of each end 100 of the product 16.

As such, the tangent point 90 of each product 16 may create a weak point along the perforations 58, 62 of the first and second weakening features 46, 50. Weak points along the first and second weakening features 46, 50 resulting from contact with the products 16 may result in damage and/or failure of the container 14 (e.g., at least a partial unintentional separation of the access panel 66 from the container 14). For example, during distribution of the container 14 or rough handling of the container 14, a portion of the perimeter edges 102 (e.g., at or near the tangent point 90) of the product 16 may burst through the container 14 along the first and second weakening features 46, 50 and/or induce and propagate tearing along the first and second weakening features 46, 50.

Thus, the first reinforcing features 92 and second reinforcing features 94 may be strategically positioned along the first row 60 forming the first weakening feature 46 and the second row 64 forming the second weakening feature 50, respectively, to prevent weak points along the first and second weakening features 46, 50 (FIG. 5). In an example implementation, the first weakening feature 46 may be defined by alternating first perforations 58 and first reinforcing features 92 along the first row 60 and the second weakening feature 50 may be defined by alternating second perforations 62 and second reinforcing features 94 along the second row 64.

The reinforcing features 92, 94 may be configured to reinforce (e.g., strengthen) the first and second weakening features 46, 50 at strategic locations along the length of the first and second rows 60, 64 (e.g., at anticipated weak points caused by the tangent points 90 of the products 16). The reinforcing features 92, 94 may be configured to not interfere with loading (e.g., inserting) of the container 14 onto the dispenser 12 (FIG. 11). The reinforcing features 92, 94 may be configured to not interfere with successful engagement between the container 14 and one or more fixtures of the dispenser 12 (e.g., a catch element 133 (FIG. 10)), as will be described in greater detail herein. The reinforcing features 92, 94 may be configured to allow separation (e.g., intentional separation) of the access panel 66 from the container 14 upon the container 14 being loaded onto the dispenser 12 (e.g., upon engagement with the catch element 133).

In an example construction, each first reinforcing feature 92 may be a portion (e.g., a longitudinal section) of the first weakening feature 46 having an absence of first perforations 58. Each second reinforcing feature 94 may be a portion (e.g., a longitudinal section) of the second weakening feature 50 having an absence of second perforations 62.

Referring to FIG. 8, each reinforcing feature, identified individually as 96, of the first and second reinforcing features 92, 94 may be sufficiently sized to support the tangent point 90 (e.g., the portion of the perimeter edge 102 of each end 100) of the product 16 that may be in contact with the base wall 28 proximate the edges 48, 52 of the container 14.

Each reinforcing feature 96 may include a length 198. The length l 98 of the reinforcing feature 96 may depend on various factors including, but not limited to, the material of the container 14, the size of the container 14, the size of the product 16, and the like. The length l 98 of the reinforcing feature 96 may be sufficient to encompass the tangent point 90 of the product 16. For example, the length l 98 of the reinforcing feature 96 may be substantially equal to the arc length of the tangent point 90. As another example, the length l 98 of the reinforcing feature 96 may be greater than the arc length of the tangent point 90. As a specific non-limiting example, the length l 98 of the reinforcing feature 96 may be greater than or equal to 0.5 mm, greater than or equal to 1 mm, greater than or equal to 1.5 mm, greater than or equal to 2 mm, greater than or equal to 3 mm, greater than or equal to 5 mm, greater than or equal to 10 mm, or greater than or equal to 20 mm.

A plurality of perforations, identified individually as 104, of the first and second perforations 58, 62 (FIG. 5) may be disposed between longitudinally aligned reinforcing features 96. Each reinforcing feature 96 may be spaced apart a longitudinal distance $d_1$ 106 from a longitudinally adjacent reinforcing feature 96 along the rows 60, 64 (FIG. 5). The distance $d_1$ 106 between adjacent reinforcing feature 96 may depend on various factors including, but not limited to, the size of the container 14, the size of the product 16, and the like. For example, the distance $d_1$ 106 may be substantially equal to a longitudinal distance between tangent points 90 of adjacent products 16. As another example, the distance $d_1$ 106 may be less than the longitudinal distance between tangent points 90 of adjacent products 16. As a specific non-limiting example, the distance $d_1$ 106 between adjacent reinforcing features 96 may be greater than or equal to 10 mm, greater than or equal to 20 mm, greater than or equal to 30 mm, greater than or equal to 40 mm, greater than or equal to 50 mm, greater than or equal to 70 mm, or greater than or equal to 90 mm.

Figure 9:
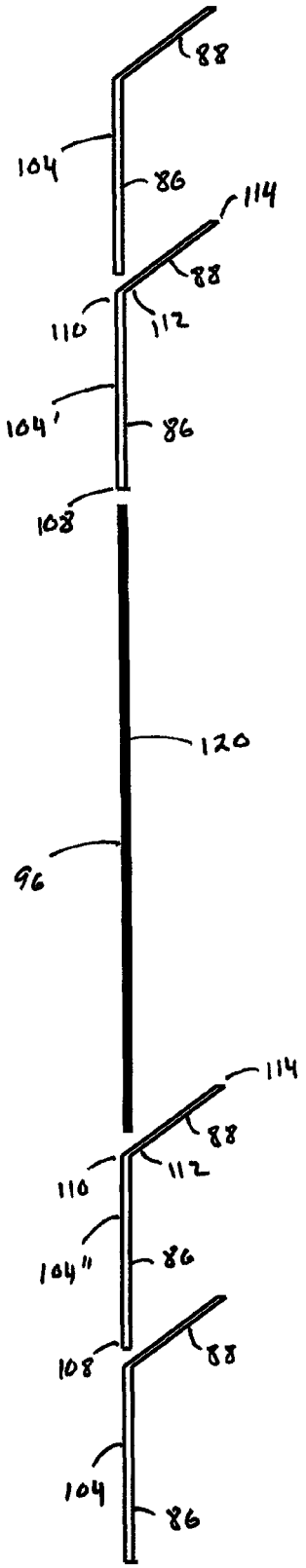
FIG. 9 is a detailed top plan view of a portion of the weakening feature shown in FIG. 6.

Referring to FIG. 9, in one particular construction, each perforation 104 of the first and second perforations 58, 62 (FIG. 5) forming the first and second weakening features 46, 50 may be formed cuts. The cuts may be generally longitudinally extending cuts. Each cut may further include a longitudinal portion 86 and an angled portion 88.

The longitudinal portion 86 may have a length, a first end 108, and a second end 110. The length of the longitudinal portion 86 may be defined by the distance between the first end 108 and the second end 110. The length of the longitudinal portion 86 may further be any suitable length of a typical zipper-like cut. As an example, the length of the longitudinal portion 86 may be greater than or equal to 0.5 mm, greater than or equal to 1 mm, greater than or equal to 1.5 mm, greater than or equal to 2 mm, or greater than or equal to 3 mm.

The angled portion 88 may have a length, a first end 112, and a second end 114. The length of the angled portion 88 may be defined by the distance between the first end 112 and the second end 114. The length of the angled portion 88 may further be any suitable length of a typical perforation or cut in accordance with the present disclosure. As an example, the length of the angled portion 88 may be greater than or equal to 0.5 mm, greater than or equal to 1 mm, greater than or equal to 1.5 mm, greater than or equal to 2 mm, or greater than or equal to 3 mm.

The angled portion 88 may extend inward from the second end 110 of the longitudinal portion 86 at a non-zero angle relative to a longitudinal axis of the longitudinal portion 86. The angle may be any suitable angle of a typical perforation or cut in accordance with the present disclosure. As an example, the angle may be greater than or equal to 20 degrees, greater than or equal to 30 degrees, greater than or equal to 40 degrees, or greater than or equal to 45 degrees.

The reinforcing feature 96 of the first and second reinforcing features 92, 94 (FIG. 6) may extend generally longitudinally between a pair of longitudinally adjacent perforations 104', 104". For example, the reinforcing feature 96 may extend from proximate (e.g., at or near) the first end 108 of the longitudinal portion 86 of a perforation 104' to proximate the second end 110 of the longitudinal portion 86 of a longitudinally adjacent perforation 104".

The reinforcing feature 96 of the first and second reinforcing features 92, 94 (FIG. 5) may be configured to allow for successful separation of the access panel 66 (FIG. 4) from the container 14 along the first and second weakening features 46, 50 upon the container 14 being loaded onto the dispenser 12. In an example construction, the first and second reinforcing features 92, 94 (FIG. 5) may be partially weakened in order to allow for continuous separation (e.g., tearing) of the access panel 66 along the first and second rows 60, 64. For example, the reinforcing features 96 may be sufficiently strong to prevent unintentional separation of the access panel 66 (e.g., during handling of the container 14) while also being sufficiently weak to allow intentional separation of the access panel 66 (e.g., upon the container 14 being loaded onto the dispenser 12).

In an example implementation, each reinforcing feature 96 of the first and second reinforcing features 92, 94 may be a pre-formed score line 120. The score line 120 may be longitudinally aligned with the perforations 104 (e.g., with the longitudinal portion 86 of the perforations 104) proximate the longitudinal edge of the base wall 28 (e.g., edges 48 and 52). For example, the score line 120 may longitudinally extend from proximate the first end 108 of the longitudinal portion 86 of the perforation 104' to proximate the second end 110 of the longitudinal portion 86 of the longitudinally adjacent perforation 104".

Those skilled in the art will appreciate that other techniques may be used to sufficiently weaken the reinforcing features 96 other than scoring the base wall 28 of the container 14.

Referring back to FIG. 5, a first reinforcing feature 92 may be positioned between and separate a plurality of first perforations 58 from a longitudinally adjacent plurality of first perforations 58. A second reinforcing feature 94 may be positioned between and separate a plurality of second perforations 62 from a longitudinally adjacent plurality of second perforations 62.

In an example construction, the first row 60 may be separated into a plurality of series of first perforations 58 by a plurality of first reinforcing features 92. The second row 64 may be separated into a plurality of series of second perforations 62 by a plurality of second reinforcing features 94.

Referring again to FIG. 6, in an example implementation, a first series of perforations 116 (e.g., a plurality of longitudinally extending perforations 104) may extend longitudinally from the edge 38 to proximate a first reinforcing feature 96'. A second series of perforations 118 may extend longitudinally from proximate the first reinforcing feature 96' to proximate a second reinforcing feature 96". A third series of perforations 122 may extend from proximate the second reinforcing feature 96" to proximate a third reinforcing feature 96'". A fourth series of perforation 124 may extend from proximate the third reinforcing feature 96'" toward the front wall 18 (FIG. 2).

The total number of reinforcing features 96 (e.g., of the first and second reinforcing features 92, 94) and the total number of series of perforations 116, 118, 122, 124 (e.g., of the first and second perforations 58, 62) may depend upon various factors including, but not limited to, the size of the container 14, the size of the product 16, the size of the access panel 66 (e.g., the size of the access opening 68), and the like.

Each series of perforations 116, 118, 122, 124 may span a longitudinal distance $d_2$ 126. The longitudinal distance $d_2$ 126 of each series of perforations may depend upon various factors including, but not limited to, the size of the product 16 (e.g., a diameter of the product 16), the location of the series of perforations with respect to the location of the products 16, the location of the reinforcing features 96 with respect to the products 16, and the like. For example, the longitudinal distance $d_2$ 126 of each series of perforations may be substantially equal to the longitudinal distance $d_1$ 106 (FIG. 8) between adjacent reinforcing features 96.

As a specific, non-limiting example, the longitudinal distance $d_2$ 126 of the first series of perforations 116 may be approximately equal to or slightly less than one-half of the diameter of the product 16 in order to position the first reinforcing feature 96' beneath the tangent point 90 of the product 16 (FIG. 8). The longitudinal distance $d_2$ 126 of the second series of perforations 118 and third series of perforations 122 may be approximately equal to or slightly less than the diameter of the product 16 in order to position the second reinforcing feature 96" and third reinforcing feature 96'" beneath the tangent point 90 of the products 16 (FIG. 8), respectively.

Figure 10:
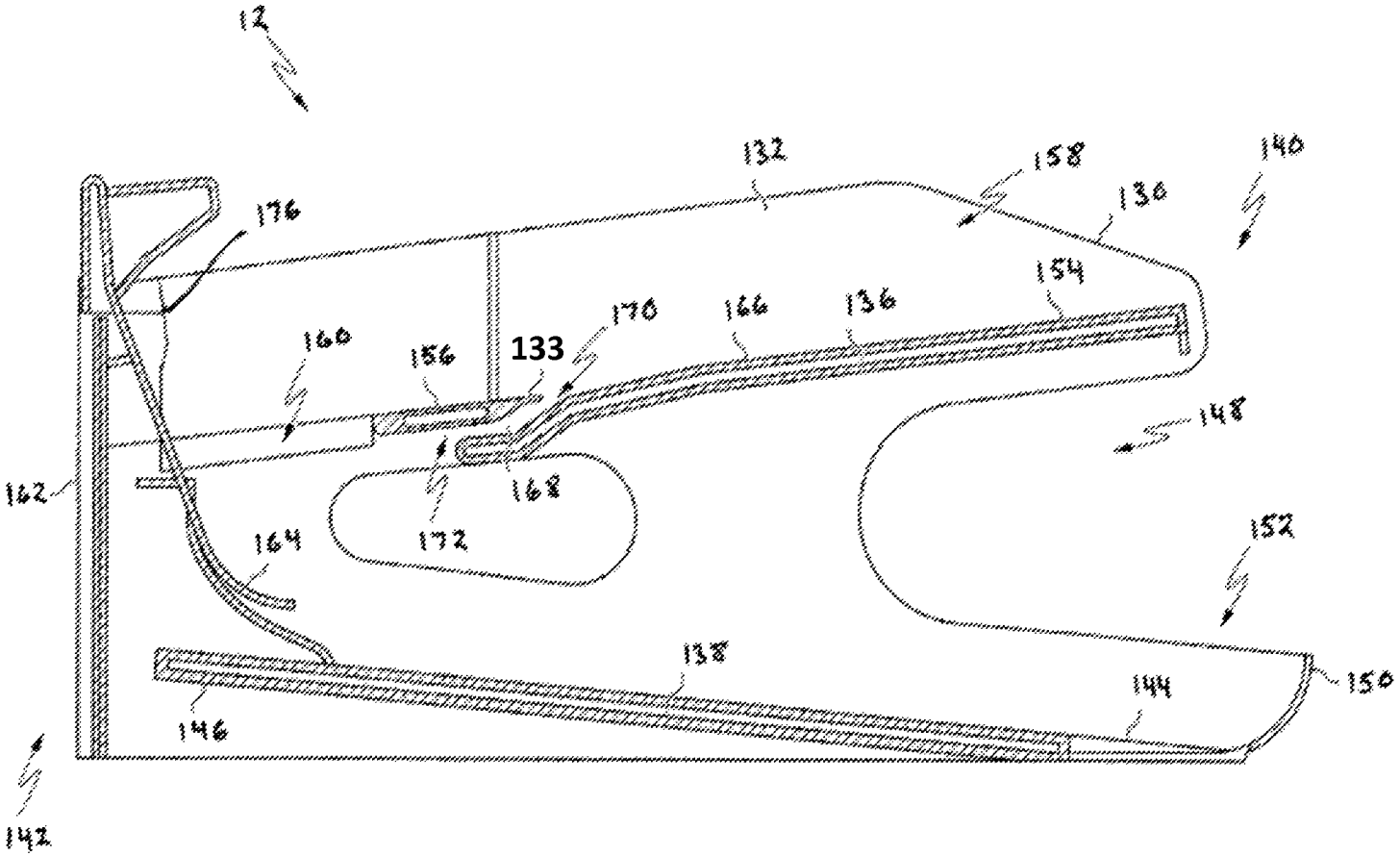
FIG. 10 is a side elevational view, in section, of one embodiment of the dispenser of the disclosed product dispensing system of FIG. 1.
Figure 11:
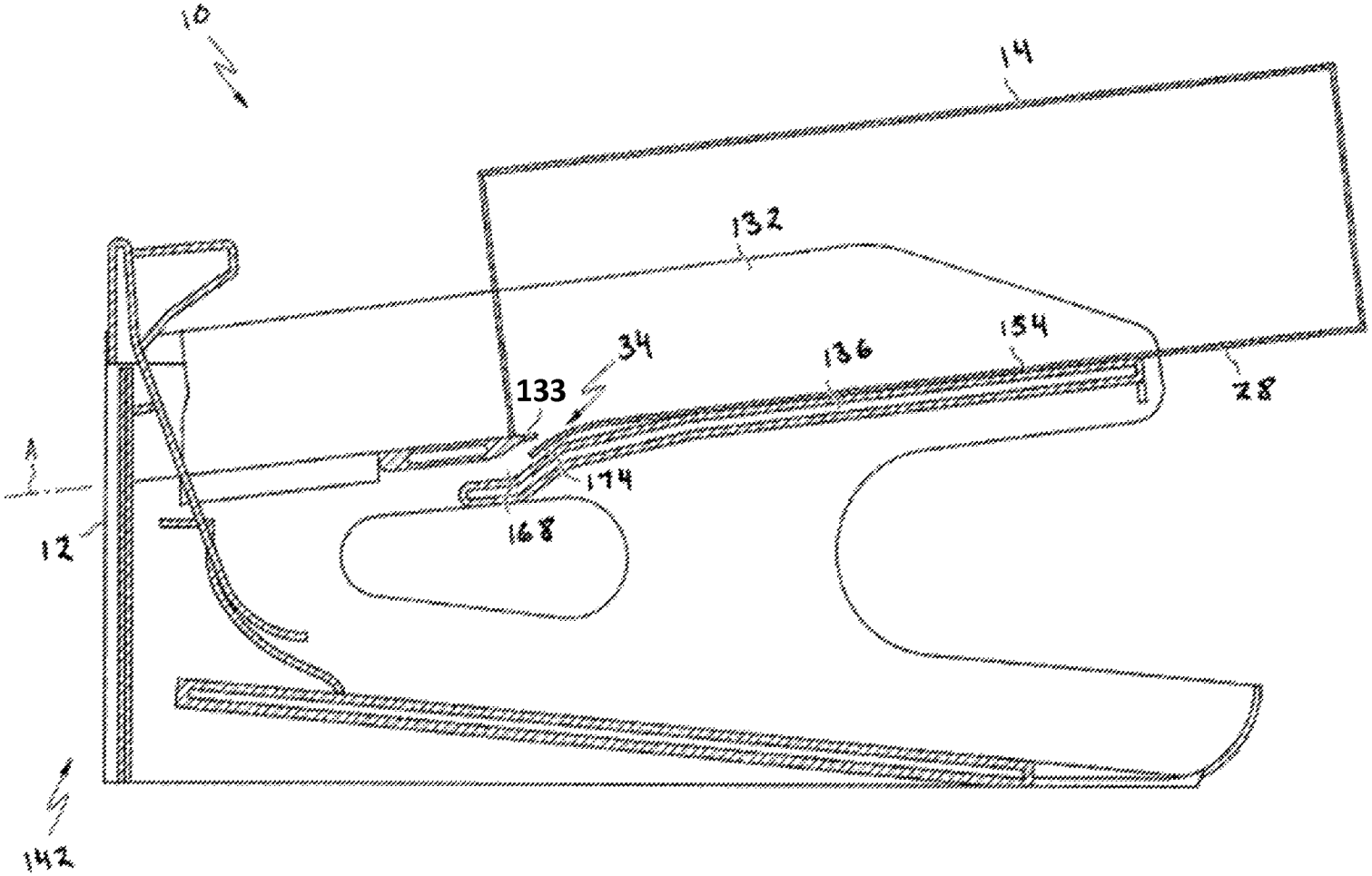
FIG. 11 is a side elevational view, in section, of the dispenser of FIG. 10, shown with the container in a first, partially loaded configuration.

Referring to FIG. 10, the dispenser 12 may include a frame 130 and a catch element 133. The frame 130 of the dispenser 12 may support the container 14 in a desired configuration, such as a slightly declined, but generally horizontal configuration, as shown in FIGS. 1, 8, 9 and 10. As the container 14 is generally horizontally urged along the dispenser 12 to the configuration shown in FIGS. 1, 9 and 10, the catch element 133 may engage the initiation opening 36 (FIG. 2) in the container 14 to separate the access panel 66 (FIG. 4) from the container 14, as is described in greater detail herein.

The frame 130 may include a first (e.g., right) sidewall 132, a second (e.g., left) sidewall 134, an upper support deck 136 and a lower support deck 138. The right sidewall 132 may be laterally spaced from the left sidewall 134, and may be generally parallel with the left sidewall 134. The frame 130 may include a first (e.g., front) end 140 and a second (e.g., rear) end 142 longitudinally opposed from the first end 140.

The lower support deck 138 may laterally extend between the right 132 and left 134 sidewalls, and may include a front end 144 that longitudinally extends toward the front end 140 of the frame 130 and a rear end 146 that longitudinally extends toward the rear end 142 of the frame 130. Therefore, the lower support deck 138 and the sidewalls 132, 134 may define a lower level 148 of the frame 130.

The lower support deck 138 may be inclined from the front end 144 to the rear end 146 (i.e., the rear end 146 may be elevated relative to the front end 144) such that products 16 deposited proximate the rear end 146 of the lower support deck 138 roll down to the front end 144 of the lower support deck 138 under the force of gravity. The extent of the incline of the lower support deck 138 may be dictated by, among other things, the coefficient of friction of the material used to form the frame 130 and the shape of the products 16 to be dispensed by the dispenser 12.

A stop 150 may be positioned proximate the front end 144 of the lower support deck 138 to prevent products 16 from rolling beyond the front end 144 of the lower support deck 138. For example, the stop 150 may be connected to (e.g., integral with) the lower support deck 138, and may form an upward curve at the front end 144 of the lower support deck 138. Therefore, the stop 150 may collect products 16 at the front end 144 of the lower support deck 138, thereby defining a product display area 152 at the front end 144 of the lower support deck 138.

The upper support deck 136 may laterally extend between the right 132 and left 134 sidewalls, and may include a front end 154 that longitudinally extends toward the front end 140 of the frame 130 and a rear end 156 that longitudinally extends toward, but not to, the rear end 142 of the frame 130. Therefore, the upper support deck 136 and the sidewalls 132, 134 may define an upper level 158 of the frame 130.

The spacing between the rear end 156 of the upper support deck 136 and the rear end 142 of the frame 130 may define an opening 160, which may function as a chute to allow products 16 to move from the upper level 158 to the lower level 148 of the frame 130. When the container 14 is in the fully loaded configuration on the dispenser 12, as shown in FIGS. 8 and 9, the access opening 68 (FIG. 4) in the container 14 may be aligned with the opening 160 defined by the frame 130.

The upper support deck 136 may be declined from the front end 154 to the rear end 156 (i.e., the front end 154 may be elevated relative to the rear end 156). Therefore, products 16 supported on the upper support deck 136 may roll under the force of gravity down to the rear end 156 of the upper support deck 136, through the opening 160, to the lower level 148 of the frame 130 and, ultimately, to the product display area 152.

An optional rear wall 162 may be positioned proximate the rear end 142 of the frame 130 between the right 132 and left 134 sidewalls. The rear wall 162 may serve as a stop that inhibits rearward horizontal movement of the container 14 (FIG. 1) along the upper support deck 136 beyond the rear wall 162.

Optionally, a container stop 176 may be connected proximate the rear end 162 of the frame 130. The stop 176 may extend into the upper level 158 of the frame 130 to inhibit rearward horizontal movement of the container 14 along the upper support deck 136 beyond the stop 176. Alternatively, the stop 176 may laterally extend between the right sidewall 132 and the left sidewall 134 of the frame 130 proximate the upper level 158 of the frame 130 to inhibit rearward horizontal movement of the container 14 along the upper support deck 136 beyond the stop 176.

A guide 164 may be connected to the rear wall 162 of the frame 130, and may extend through the opening 160 in the frame 130, from the upper level 158 to the lower level 148. The guide 164 may be a ramp-like structure, and may be positioned to receive products 16 exiting the container 14 and passing through the opening 160 in the frame 130, and may guide the products 16 to the rear end 146 of the lower support deck 138.

The catch element 133 may be positioned between the front end 154 and the rear end 156 of the upper support deck 136. For example, the catch element 133 may be positioned proximate the rear end 156 of the upper support deck 136.

The catch element 133 may laterally extend between the sidewalls 132, 134 of the frame 130, and may longitudinally protrude toward the front end 140 of the frame 130. The specific size and shape of the catch element 133 may depend on the size and shape of the initiation opening 36 in the container 14.

In an effort to minimize interference between the catch element 133 and the container 14 during loading, the catch element 133 may be substantially co-planar with the upper surface 166 of the upper support deck 136. However, those skilled in the art will appreciate that slight displacement and/or a slight angle of the catch element 133 relative to the upper surface 166 of the upper support deck 136 may encourage engagement of the initiation opening 36 in the container 14 by the catch element 133 during loading of the container 14 onto the dispenser 12.

While the catch element 133 is shown and described as a generally flat, laterally elongated and forwardly extending protrusion, those skilled in the art will appreciate that various alternative structures may be used as the disclosed catch element 133 without departing from the scope of the present disclosure. For example, suitable catch elements may include various hooks, protrusions, flanges, detents and the like sufficient to engage the initiation opening 36 in the container 14 and separate the access panel 66 from the base wall 28 of the container 14.

The upper support deck 136 may define a channel 168 positioned to guide the access panel 66 below the upper surface 166 of the upper support deck 136 as the access panel 66 is separated from the container 14 by the catch element 133. The channel 168 may extend from an entrance opening 170 proximate the catch element 133, down below the catch element 133 and, ultimately, to an exit opening 172. The channel 168 may laterally extend between the sidewalls 132, 134 of the frame 130, and may have a lateral width sufficient to allow the access panel 66 (FIG. 4) to pass therethrough. The channel 168 may extend longitudinally along the upper support deck 136 from the entrance opening 170 toward the rear end 142 of the frame 130. Alternatively, the channel 168 may extend longitudinally along the upper support deck 136 from the entrance opening 170 toward the front end 140 of the frame 130.

Thus, the catch element 133 may engage the initiation opening 36 (FIG. 2) in the container 14 and may separate the access panel 66 (FIG. 4) from the container 14 as the container 14 is moved horizontally along the upper support deck 136 toward the rear end 142 of the frame 130. The shape and position of the catch element 133 may be configured such that a portion of the catch element 133 extends through the initiation opening 36 (FIG. 2) in the container 14. Therefore, as the container 14 moves relative to the catch element 132, the catch element 132 may urge the base wall 28 downward through the opening 170 and into the channel 168, thereby causing separating of the access panel 66 (FIG. 4) from the container 14 along the first and second weakening features 46, 50 (FIG. 2) and, ultimately, the formation of the access opening 68 (FIG. 4) in the container 14.

Optionally, the frame 130 may include one or more intermediate support decks (not shown) positioned between the upper support deck 136 and the lower support deck 138. The intermediate support deck may include a front end that longitudinally extends toward the front end 140 of the frame 130 and a rear end that longitudinally extends toward, but not to, the rear end 142 of the frame 130 defining an intermediate level of the frame 130. The spacing between the rear end of the intermediate support deck and the rear end 142 of the frame 130 may define an intermediate opening, which may function as a chute to allow products 16 to move from the intermediate level down to the lower level 148 of the frame 130 under the force of gravity. The intermediate support deck may be inclined from the front end to the rear end such that products 16 deposited proximate the rear end of the intermediate support deck roll down to the front end of the intermediate support deck under the force of gravity. An intermediate stop may be positioned proximate the front end of the intermediate support deck to prevent products 16 from rolling beyond the front end of the intermediate support deck and collect products 16 at the front end of the intermediate support deck, thereby defining a second product display area (not shown) proximate the front end of the intermediate support deck. The second product display area may be longitudinally displaced (e.g., inwardly) and/or vertically displaced (e.g., upwardly) relative to the product display area 152.

Figure 12:
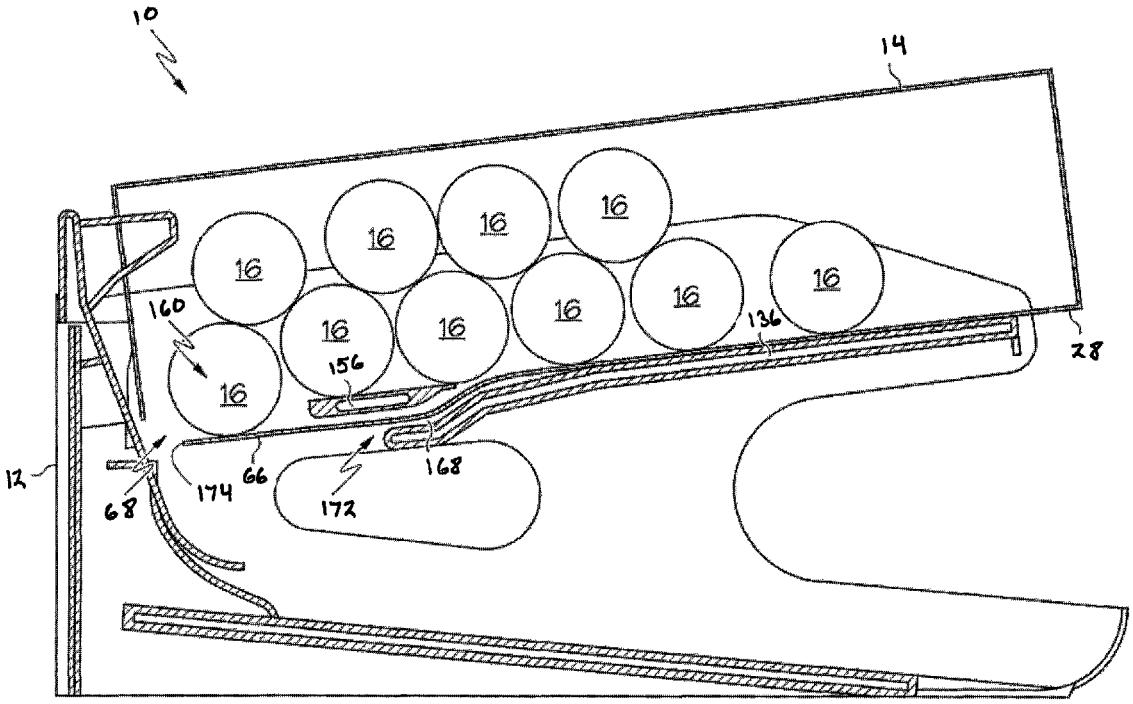
FIG. 12 is a side elevational view, in section, of the dispenser of FIG. 10, shown with the container in a second, fully loaded configuration.
Figure 13:
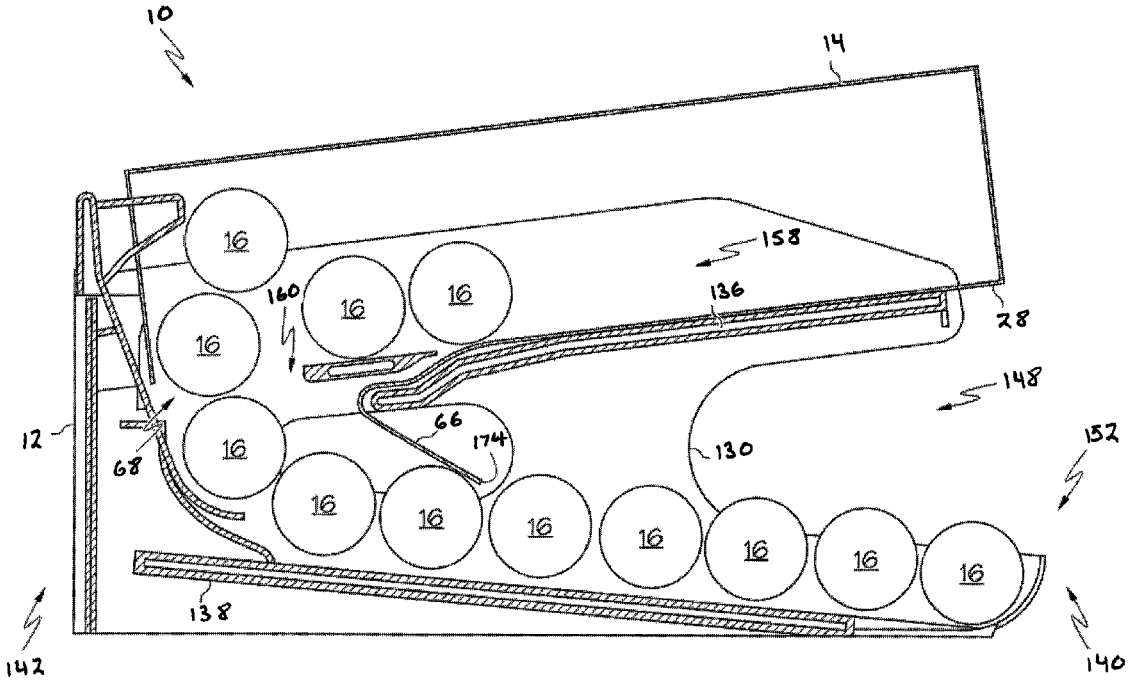
FIG. 13 is a side elevational view, in section, of the dispenser of FIG. 10, shown with the container in a third, dispensing configuration.

FIGS. 11-13 illustrate the container 14 being loaded onto the dispenser 12 such that the catch element 133 of the dispenser 12 engages and opens the container 14, thereby releasing the products 16 initially housed in the container 14 to the dispenser 12. Specifically, FIGS. 11 and 13 illustrate the container 14 being urged generally horizontally along the upper support deck 136 (e.g., along the longitudinal axis A of the upper support deck 136) toward the rear end 142 of the dispenser frame 130, thereby automatically opening the container 14 and dispensing the products 16 from the container 14 to the dispenser 12.

As shown in FIG. 11, as the initiation opening 36 in the container 14 approximates the catch element 133 of the dispenser 12, the catch element 133 may pass through the initiation opening 36. With the catch element 133 extending through the initiation opening 36, a rear edge 174 of the base wall 28 (e.g., the edge 38) of the container 14 may be directed downward through the entrance opening 170 of the channel 168.

As shown in FIG. 12, as the container 14 continues to longitudinally move along the upper support deck 136 toward the rear end 142 of the dispenser 12, the base wall 28 of the container 14 may pass through the channel 168, thereby separating the access panel 66 from the base wall 28 along the first and second weakening features 46, 50 (FIG. 2).

As shown in FIG. 13, with the container 14 fully loaded onto the dispenser 12, the access opening 68 formed in the container 14 may be aligned with the opening 160 between the upper level 158 and the lower level 148 of the frame 130. Therefore, the force of gravity may urge the products 16 initially housed in the container 14 through the access opening 68 in the container 14, through the opening 160 in the frame 130, down to the lower support deck 138 and, ultimately, to the product display area 152.

Accordingly, the use of reinforcing features as described herein may provide one or more advantageous methods of forming the access panel. Such methods may be advantageous because the weakening features may be less likely to separate in response to normal or extreme handling of the container, thus reducing damage to the container. Other advantages may also become apparent to those skilled in the art.

Although various embodiments of the disclosed product dispensing system have been shown and described, modifications may occur to those skilled in the art upon reading the specification. The present application includes such modifications and is limited only by the scope of the claims.

What is claimed is:

1. A product dispensing system comprising:

a container comprising a plurality of walls that define an internal volume and an opening into said internal volume;

wherein said container defines a plurality of first perforations and at least one first reinforcing feature arranged in a first row extending from said opening and a plurality of second perforations and at least one second reinforcing feature arranged in a second row extending from said opening;

wherein said first reinforcing feature comprises at least one first score line disposed in said container between longitudinally adjacent first perforations of said plurality of first perforations, and said second reinforcing feature comprises at least one second score line disposed in said container between longitudinally adjacent second perforations of said plurality of second perforations.

2. The product dispensing system of claim 1 wherein said first row extends along a first edge between two adjacent walls of said plurality of walls, and said second row extends along a second edge between two adjacent walls of said plurality of walls.

3. The product dispensing system of claim 1 wherein said first row is substantially parallel to said second row.

4. The product dispensing system of claim 1 wherein said first reinforcing feature is substantially parallel to and aligned with said second reinforcing feature, said first and second reinforcing features being disposed at positions corresponding to one or more potential weak points along said first and second rows.

5. The product dispensing system of claim 1 wherein said first reinforcing feature separates longitudinally adjacent first perforations, and said second reinforcing feature separates longitudinally adjacent second perforations.

6. The product dispensing system of claim 1 wherein said first reinforcing feature comprises a first portion of said container disposed between longitudinally adjacent first perforations of said plurality of first perforations, and said second reinforcing feature comprises a second portion of said container disposed between longitudinally adjacent second perforations of said plurality of second perforations.

7. The product dispensing system of claim 1 wherein each perforation of said plurality of first perforations is formed as an elongated cut in said container, and wherein each perforation of said plurality of second perforations is formed as an elongated cut in said container.

8. The product dispensing system of claim 1 wherein said container comprises a plurality of products received in said internal volume.

9. The product dispensing system of claim 8 wherein said first reinforcing feature and said second reinforcing feature are positioned to align with one or more points of contact between a product of said plurality of products and said container.

10. The product dispensing system of claim 1 further comprising:

a dispenser comprising:

a frame configured to support said container; and a catch element connected to said frame, said catch element being positioned to extend through said opening when said container is loaded onto said frame.

11. The product dispensing system of claim 10 wherein said frame comprises two opposed sidewalls and a support deck between said opposed side walls, said support deck having a front end and a rear end; and wherein said catch element is connected to said support deck.

12. The product dispensing system of claim 11 wherein said support deck defines an upper surface and a channel that extends below said upper surface, said channel having an entrance opening proximate said catch element and an exit opening; and wherein a portion of said container is received in said channel.

13. A product dispensing system comprising:

a container comprising at least a base wall and a rear wall that define an internal volume and an opening into said internal volume; and wherein said base wall defines a plurality of first perforations and a plurality of first reinforcing features arranged in a first row extending from said opening, and a plurality of second perforations and a plurality of second reinforcing features arranged in a second row extending from said opening;

wherein each first reinforcing feature extends a first length between said first perforations, and each second reinforcing feature extends a second length between said second perforations; the first length and the second length each being greater than or equal to 10 mm;

a plurality of products received in said internal volume of said container; and a dispenser comprising:

a frame comprising a front end and a rear end, said frame comprising a support deck configured to support said container; and a catch element connected to said support deck, said catch element being positioned to extend through said opening when said container is loaded onto said support deck.

14. The product dispensing system of claim 13 wherein said first row extends along a first longitudinal edge of said base wall, and said second row extends along a second longitudinal edge of said base wall; and wherein said first row is substantially parallel to said second row.

15. The product dispensing system of claim 13 wherein each first reinforcing feature of said plurality of first reinforcing features is substantially parallel to and aligned with each second reinforcing feature of said plurality of second reinforcing features.

16. The product dispensing system of claim 13 wherein:

each first reinforcing feature of said plurality of first reinforcing features comprises at least one first score line disposed in said base wall between longitudinally adjacent first perforations of said plurality of first perforations; and each of said second reinforcing features of said plurality of second reinforcing features comprises at least one second score line disposed in said base wall between longitudinally adjacent second perforations of said plurality of second perforations.

17. The product dispensing system of claim 13 wherein said plurality of first reinforcing features and said plurality of second reinforcing features are positioned to align with tangent points of said plurality of products.

18. The product dispensing system of claim 13 wherein first row and said second row define an access panel in said base wall; and wherein said access panel is opening by said catch element as said container is loaded onto said frame.

19. The product dispensing system of claim 13, where the first length and the second length are each greater than or equal to 20 mm.

20. A method for dispensing comprising:

providing a container housing a plurality of products, said container comprising a plurality of first perforations and at least one first reinforcing feature arranged in a first row and a plurality of second perforations and at least one second reinforcing feature arranged in a second row; wherein said first row and said second row define an access panel;

wherein said first reinforcing feature comprises at least one first score line disposed in said container between longitudinally adjacent first perforations of said plurality of first perforations, and said second reinforcing feature comprises at least one second score line disposed in said container between longitudinally adjacent second perforations of said plurality of second perforations;

providing a dispenser comprising a frame configured to support said container and a catch element connected to said frame; and urging said container along said frame such that said catch element separates said access panel about said first row and said second row and allows at least one product of said plurality of products to be dispensed from said container.

* * * * *